United States Patent [19]

Washer

[11] 4,309,273

[45] Jan. 5, 1982

[54] REMOVAL OF CRACKING CATALYST FINES

[75] Inventor: Stone P. Washer, Bartlesville, Okla.

[73] Assignee: Phillips Petroleum Company, Bartlesville, Okla.

[21] Appl. No.: 184,837

[22] Filed: Sep. 8, 1980

[51] Int. Cl.[3] ..... C10G 11/18

[52] U.S. Cl. ..... 208/78; 208/113; 208/120

[58] Field of Search ..... 208/78, 177, 113, 120

[56] References Cited

U.S. PATENT DOCUMENTS

| | | | |
|---|---|---|---|
| 2,349,575 | 5/1944 | Voorhees | 208/74 |
| 2,767,126 | 10/1956 | Rice | 208/74 |
| 2,794,710 | 6/1957 | Lawson | 208/87 |
| 3,758,400 | 7/1973 | Hampton | 208/72 |
| 3,904,509 | 9/1975 | Anthoney | 208/113 |
| 4,148,712 | 4/1979 | Nielsen et al. | 208/78 |
| 4,222,856 | 9/1980 | Hansel et al. | 208/120 |

*Primary Examiner*—Delbert E. Gantz
*Assistant Examiner*—G. E. Schmitkons

[57] ABSTRACT

Cracking catalyst fines that are separated from the cracked fluid leaving the cracking or separation zone of a catalytic cracker are not dropped back into the separation zone or cracker and thus are not left in the cracker-regenerator loop but rather are removed from this loop, e.g., by connecting the dip-leg of one or more of the cyclones in the cracker with a conduit guiding these fines to a location of disposal outside of the catalyst loop. In one embodiment, these fines are introduced into another catalytic cracker or the separation vessel associated with a further catalytic cracker so that these fines ultimately occur in the bottoms product from a fractionator associated with this further cracker. By this process, the bottoms product of the main fractionator associated with the main cracker can be more efficiently utilized for the production of a carbon black feedstock because this bottoms product contains a very significantly reduced quantity of catalyst fines.

11 Claims, 1 Drawing Figure

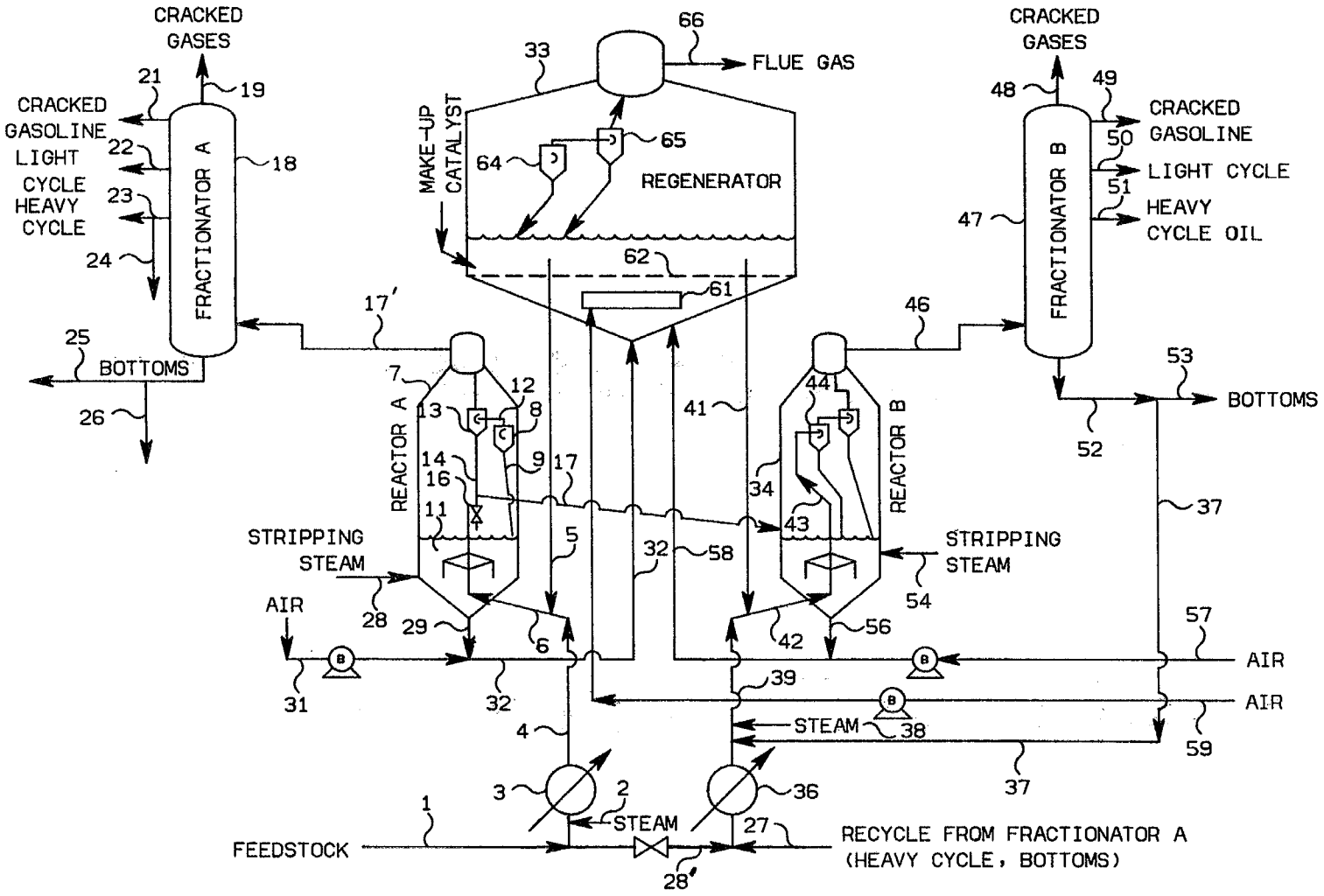
CRACKED GASES
CRACKED GASOLINE
LIGHT CYCLE
HEAVY CYCLE OIL
BOTTOMS
FRACTIONATOR B
FLUE GAS
REGENERATOR
MAKE-UP CATALYST
REACTOR B
STRIPPING STEAM
AIR
STEAM
RECYCLE FROM FRACTIONATOR A (HEAVY CYCLE, BOTTOMS)
REACTOR A
FEEDSTOCK
FRACTIONATOR A
CRACKED GASOLINE
LIGHT CYCLE
HEAVY CYCLE

REMOVAL OF CRACKING CATALYST FINES

BACKGROUND OF THE INVENTION

Catalytic cracking processes become increasingly important. In a catalytic cracking process frequently a cyclic operation of the cracking catalyst is used. In this cyclic operation, the catalyst is advanced through a loop from a cracking zone through a separation zone and a regeneration zone back to the cracking zone. In the cracking zone, the cracking catalyst is contacted with the hydrocarbon feedstock under cracking conditions to produce lower molecular weight hydrocarbons. In the separation zone, the cracking catalyst and the hydrocarbons are separated. In the regeneration zone, the cracking catalyst is contacted with a free oxygen containing gas to burn off any coke present on the cracking catalyst and to restore the cracking activity of this catalyst.

During the process, the cracking catalyst particles generate cracking catalyst fines which are difficult to separate from the gases. The usual operation applied in the industry involves a separation of the fines from the hydrocarbon product and these fines remain either in the separator or are recombined with the main larger cracking catalyst particles in the cracking catalyst loop described above. The fines also, to a certain extent, are separated in the regenerator. Since fines are constantly generated in the process, it is necessary to either employ a very efficient method for separating the fines or to let a portion of the fines escape through the regenerator stack or with the hydrocarbon product. In today's commercial cracking operations, usually both paths of loss of cracking catalyst fines do occur. In a typical cracking operation using a catalytic cracker containing 300 tons of circulating cracking catalyst, it is not uncommon that daily, between 6 and 10 tons of catalyst fines leave the loop in part through the regenerator stack and in part with the hydrocarbon product.

It is also well known in the art to subject the hydrocarbon product from the cracking zone and containing some of the cracking catalyst fines to an initial fractionation step. Most of the cracking catalyst fines contained in the cracked hydrocarbon product will leave this fractionation step with the bottoms product. This bottoms product is known to be useful as a carbon black feedstock. However, the quality of the carbon black made with such a feedstock depends to a significant extent upon the content of catalyst fines. These catalyst fines form ceramic grit which is undesirable for many of the modern applications of the carbon black and customer specifications for the carbon black therefore frequently set an upper limit for such grit content. In some instances, it has therefore become necessary to subject the bottoms stream from the first fractionator to a separation step to separate as much of the cracking catalyst fines from the oil as possible prior to its use in a carbon black production operation. Such a separation step is, of course, costly and therefore undesirable.

THE INVENTION

It is therefore one object of this invention to provide a cracking process wherein the quantity of cracking catalyst fines contained in the hydrocarbon product is reduced as compared to known cracking catalyst operations.

Another object of this invention is to provide a process for generating an improved carbon black feedstock as one of the products of a catalytic cracking operation.

Still another object of this invention is to provide a hydrocarbon cracking process allowing the withdrawal and disposal of catalyst fines in an efficient way.

These and other objects, advantages, features, and embodiments of this invention will become apparent to those skilled in the art from the following detailed description of the invention, the appended claims and the drawing which shows a schematic flow sheet of an operation in accordance with this invention.

In accordance with this invention, a cracking process is provided for in which the cracked hydrocarbon product entraining catalyst fines is subjected to a separation step removing at least a significant portion of these entrained cracking catalyst fines from the hydrocarbon product stream. In accordance with this invention, these removed cracking catalyst fines are not dropped back into the catalyst loop, but rather are removed from this loop entirely. This last step of removal of the cracking catalyst fines from the loop is extremely easily carried out because these catalyst fines in the typical industrial operation are separated from the hydrocarbon product so that the only thing required is a conduit guiding the separated fines out from the loop, e.g., out of the separator vessel.

In accordance with a first embodiment of this invention, a catalytic cracking process is provided for which comprises the following steps. The hydrocarbon feedstock and the cracking catalyst are contacted in a cracking zone under cracking conditions to produce a mixture of cracked hydrocarbons and cracking catalyst. The mixture is separated in a separation zone into a cracking catalyst mass containing coke and a fluid mass consisting essentially of the cracked hydrocarbons and cracking catalyst fines. The cracking catalyst mass is regenerated by contacting it with a free oxygen containing gas such as to combust at least a significant portion of the coke and to thereby produce a regenerated cracking catalyst mass. The regenerated cracking catalyst mass is reintroduced into the cracking zone as at least part of the cracking catalyst therein. The cracking catalyst thus moves in a loop from the cracking zone through a separation zone and a regeneration zone back to the cracking zone. At least a significant portion of the cracking catalyst fines are separated from the cracked hydrocarbon. In accordance with this invention, these so-separated cracking catalyst fines are not left in the loop of the cracking catalyst, but rather are removed from this loop. By the process of this invention, the hydrocarbon product contains less cracking catalyst fines than the hydrocarbon product in the standard operation, the difference of cracking catalyst fines contained in the hydrocarbon product stream being approximately equal to the additional removal of cracking catalyst fines from the cracking or separation zone. This significant improvement in the product quality is made essentially without sacrifice in the overall operating cost since the total quantity of cracking catalyst fines removed from the loop remains the same and equals the total quantity of catalyst fines generated in the loop.

In accordance with a second embodiment of this invention, a process is provided for producing an improved intermediate product for the production of a carbon black feedstock. This process involves the same cracking operation including the removal of the cracking catalyst fines from the cracking or separating zone described above. In addition, the hydrocarbon product stream containing the reduced amount of cracking catalyst fines is subjected to fractionation. In this fractionation, a bottoms product or oil product is produced which contains a significantly reduced amount of cracking catalyst fines as compared to an operation including no withdrawal step for the catalyst fines as described. In this embodiment of the invention, too, the already existing separation of the catalyst fines from the cracked hydrocarbon product is utilized and instead of simply leaving the separated cracking catalyst fines within the loop, i.e., by returning these fines through the dip-leg of a cyclone into the separating zone following the cracker, these fines are simply withdrawn from this loop and disposed of. Therefore, the reduction in the cracking catalyst fines content of the oil product removed from the bottoms product of the fractionator is achieved without any additional energy requirement.

It should also be noted that metals such as nickel, vanadium or iron from the hydrocarbon feedstock concentrate on the surface of the cracking catalyst particles. Therefore, the cracking catalyst fines that are produced from the surface of these cracking catalyst particles contain a disproportionately high amount of metals per weight unit for that reason and also for the reason of the higher surface area of a weight unit of such cracking catalyst fines. The removal of such cracking catalyst fines from the separation zone therefore reduces the degrading effect that the metals concentrated on the cracking catalyst fines surface have on the cracked products. This degrading effect exists predominantly in the form of hydrogen formation and correspondingly the formation of unsaturation and coke.

The cracking catalyst used in the process of this invention as the fresh catalyst usually has a particle size in the range of 200–400 mesh (corresponding to a particle size of 74-37 microns). The catalyst fines envisaged for the withdrawal from the cracking zone or from the separation vessel from the cracking zone are the finest of the catalyst fines, namely those particles having a size that allows them to pass through a sieve of 550 mesh. In other words, the finest fines that are removed in a typical cracking operation in accordance with this invention have a particle size of 25 microns or smaller.

In accordance with still another embodiment of this invention, a twin-loop catalytic cracking process is provided for. This twin-loop process involves a first cracker-regenerator loop operation and a second cracker-regenerator loop operation. The cracking catalyst fines from the cracker, or respectively separation vessel following the cracker, are removed from this first loop and are introduced into the cracker, or respectively separating vessel following the cracker of the second loop. By this operation, the cracking catalyst fines from the first loop are withdrawn and appear in the bottoms product of the fractionator associated with the second cracker-regenerator loop operation. This embodiment of this invention has the following significant advantages: first, the bottoms product from the fractionator associated with the first cracker-regenerator loop has a reduced cracking catalyst fines content. Therefore, these bottoms can more readily be utilized in an operation for producing a carbon black feedstock. Second, the operation allows the introduction of cracking catalyst fines into a cracker-regenerator loop which may have a higher capacity for handling cracking catalyst fines in the fractionator than the first cracker-regenerator loop. Furthermore, the operation allows the use of a more valuable feedstock in the first cracker-regenerator loop improving the bottoms oil stream withdrawn from the fractionator associated with this first loop whereas the added detriment to the bottoms stream withdrawn from the fractionator associated with the second cracker-regenerator loop may be of reduced or no significance at all when a heavy recycle material which already contains a significant amount of solid impurities is used as the feedstock in the second cracker-regenerator loop.

In this third embodiment of this invention, namely the twin-loop catalytic cracking process, it is presently preferred to arrange the two loops in such a manner that they have the regenerator in common. Despite this fact, there is no danger of significant back flow of the cracking catalyst fines removed from one catalytic cracker and introduced into the other cracker because these fines essentially completely leave this cracker or separation vessel of the second loop with the hydrocarbon product and therefore never reach the regenerator in which both the catalysts from the first loop and the catalyst from the second loop is regenerated.

The production of carbon black feedstock oil from the bottoms product of a fractionator is per se well known and involves filtration and solvent extraction steps. Such a process is, for instance, described in U.S. Pat. No. 2,794,710 (1957) which shows charging decant oil from a catalytic cracking to a solvent extraction to produce high aromatic content carbon black feedstock; and U.S. Pat. No. 3,758,400 (1973) which shows producing decant oil from the catalytic cracking unit fractionator bottoms using a separator.

The invention removes part of the catalyst fines in a fluid-type or riser type catalytic cracking of a hydrocarbon from the cracked effluent charged to fractionation to produce cracked products including highly aromatic oil which is suitable as the feedstock for a carbon black manufacture. By decreasing the amount of catalyst entering the fractionation less catalyst is present in the aromatic oil and less ceramic grit will be present in the carbon black produced from this aromatic oil. Also, the catalyst particles remaining are more easily removed from the oil, e.g., by centrifuge or filtration when such removal is required.

In an embodiment of the invention, a part of the catalyst fines present in the catalytic cracking zone are removed from that zone in the dip-leg of one or more of the final stage cyclone separator(s).

In another embodiment, these fines are charged to a second catalytic cracking zone from which an aromatic oil is not recovered as a carbon black feedstock.

In a specific embodiment, that reactor from which these fines are removed is at a higher pressure than that reaction system to which these fines are transferred. It is noted, however, that the reactors do not have to be of different pressures, one can be at a higher or lower pressure than the other, or they each can be at the same pressure. The fines can be transferred, e.g., from a lower pressure reactor to a higher pressure (or same pressure) reactor using pneumatic, gravity, or mechanical means (auger, etc.).

Referring to the drawing, which is a schematic flow of an embodiment of the invention, virgin gas oil 1, from such as atmospheric distillation of a crude oil, steam 2, are combined and indirectly heated in heat exchanger 3, passed via conduit 4, admixed with regenerated cracking catalyst 5 and charged via conduit 6 to reactor 7, referred to as Reactor A. Cracked vapors containing catalyst entrainment enter primary cyclone 8 (which can be a set of cyclones in parallel arrangement). Catalyst from cyclone 8 is passed via dip-leg 9 to the catalyst mass 11 in reactor 7. Cracked vapors containing some catalyst fines are passed via conduit 12 from cyclone 8 to secondary cyclone 13 (which can be a set of cyclones in parallel arrangement, a cyclone unit 13 being in series with a cyclone unit 8). Catalyst fines from cyclone 13 are passed via conduit 14, and, in part, can be returned via valve 16 to reactor 7 and at least in part via conduit 17, the disposal of which fines are described hereinbelow. Cracked hydrocarbon vapors, substantially free of catalyst, are passed via conduit 17' to fractionator 18, referred to as Fractionator A, wherefrom cracked gases 19, cracked gasoline 21, light cycle oil 22, heavy cycle oil 23, and bottoms 25 are recovered as products. A portion of the heavy cycle oil and/or bottoms can, respectively, be removed via conduits 24 and 26 and charged to Reactor B, described hereinbelow, via conduit 27. Bottoms 25, a highly aromatic oil, substantially free of catalyst, can be charged to a carbon black manufacture. This stream 25 can be centrifuged or filtered prior to charging it to a carbon black manufacture. This stream can be subjected to solvent extraction to further concentrate the aromatics for feed to carbon black (not shown).

Spent catalyst 11 in reactor 7 is steam stripped via steam 28 to remove entrained and occluded hydrocarbons and passed via conduit 29 and along with regeneration air 31 via conduit 32 to regenerator 33 wherein the coke which had been deposited on the catalyst in the cracking reaction is at least in part removed by combustion with oxygen to produce the regenerated catalyst 5, above referred to.

Catalyst fines 17 from cyclone 13 are charged to catalytic reactor 34 whereinto recycle stocks are charged for cracking. Recycle stock 27, above-described, and, optionally some virgin gas oil 28', is indirectly heated in heat exchanger 36. Recycle bottoms 37, described hereinbelow, is added to the effluent from exchanger 36 and steam 38 is added thereto and the admixture is passed via conduit 39 into which mass regenerated catalyst 41 is added and the final mass is passed via conduit 42 to reactor 34, referred to as Reactor B. The mass reacts in riser 43 and exits into cyclone separation means designated 44 wherefrom catalyst is removed conventionally and returned to the reactor 34 through dip-legs (not numbered). Cracked product is passed via 46 to fractionator 47, referred to as Fractionator B, wherefrom are recovered cracked gases 48, cracked gasoline 49, light cycle oil 50, heavy cycle oil 51 and bottoms 52. Bottoms 52 can, in part, be yielded at 53 and, in part, recycled via 37 as above-described. Spent catalyst is steam stripped with steam 54, to remove entrained and occluded hydrocarbons therefrom, and passed via conduit 56 along with regeneration air 57 by way of conduit 58 to regenerator 33. Additional air can be charged via conduit 59 and sparger 61, below grid 62, to regenerator 33. Combustion gases are passed to cyclones 64 and 65 with flue gas exiting at 66.

Following is a typical (calculated) operation using the invention. The reactor producing the carbon black feedstock is at a higher pressure than the other reactor to which the catalyst fines are transferred. The reference numerals refer to the drawing.

| Typical Operation | |
|---|---|
| (1) Feed Oil | |
| API Gravity, 60/60° F. | 27.4 |
| Boiling Range, °F. | 350 to 1050 |
| Metals (Ni, V, Fe), ppm by wt. | Ni = .65, V-1.6 |
| (4) Feed Oil to Reactor (A) | |
| Volume, BBl/Hr, | 1125 |
| Temperature, °F. | 650 |
| (2) Steam to Reactor (A) | |
| Pounds/Hr. | 3000 |
| Temperature, °F. | 600 |
| (5) Regenerated Catalyst | |
| Tons/Minute | 12.1 |
| Temperature, °F. | 1375 |
| (28) Feed Oil to Reactor (B) | |
| Volume BBl/Hr. | 250 |
| Temperature, °F. | 650 |
| (38) Steam to Reactor (B) | |
| Pounds/Hr. | 1800 |
| Temperature, °F. | 600 |
| (37) Recycle Slurry Oil (B) | |
| Volume, BBl/Hr. | 110 |
| Temperature, °F. | 660 |
| (41) Regenerated Catalyst | |
| Tons/Minute | 3.4 |
| Temperature, °F. | 1375 |
| Reactor (A) Fractionation (A) Yields | |
| (19) Cracked Gases, SCF/Day | 16,300,000 |
| (21) Cracked Gasoline, BBl/Hr. | 429 |
| (22) Light Cycle Oil, BBl/Hr. | 193 |
| (23) Heavy Cycle Oil, BBl/Hr. | 0 |
| (25) Bottoms Yield, BBl/Hr. | 193 |
| (a) BMCI, | 100 |
| Boiling Range, °F. | 620 to 1050 |
| Catalyst Content, Wt. % | 0.01 |
| (a) Bureau of Mines Correlation Index. | |
| Reactor (B) Fractionation (B) Yields | |
| (23) Cracked Gases, SCF/Day | 4,000,000 |
| (24) Cracked Gasoline, BBl/Hr. | 140 |
| (26) Light Cycle Oil, BBl/Hr. | 85 |
| (27) Heavy Cycle Oil, BBl/Hr. | 0 |
| (28) Bottoms Product, BBl/Hr. | 81 |
| Catalyst Content, Wt. % | 2.0 |
| (17) Catalyst Fines Transfer | |
| Pounds/Hr. | 80,000 |
| Operating Conditions | |
| Reactor (A) | |
| Pressure, psig | 17.4 |
| Temperature, °F. | 1005 |
| Cat/Oil Wt. Ratio | 4.6 |
| Residence Time, Sec. | 0.63 |
| Reactor (B) | |
| Pressure, psig | 15.4 |
| Temperature, °F. | 1010 |
| Cat/Oil Wt. Ratio | 4.8 |
| Residence Time, Sec. | 1.77 |
| Regenerator | |
| Pressure, psig | 5 |
| Dense Bed Temp., °F. | 1375 |
| Dilute Phase Temp., °F. | 1389 |
| Spent Catalyst | A = 0.84; B = 1.14 |
| Wt. % Coke | |
| Regenerated Catalyst | 0.08 |
| Wt. % Coke | |
| Total Air, SCF/Min. | 75,100 |
| Fractionator (A) | |
| Top Temp., °F. | 308 |
| Bottom Temp., °F. | 690 |
| Pressure, psig | 16.5 |
| Fractionator (B) | |
| Top Temp., °F. | 260 |
| Bottom Temp., °F. | 660 |
| Pressure, psig | 15 |

Using the catalyst fines 17 transfer from Reactor (A), from the dip-leg 14 of the final cyclone separator, to the system of Reactor (B), the bottoms yield 25 from Fractionator (A) will have only 0.01 weight percent catalyst therein, since part of the catalyst fines are not allowed to enter Fractionator A. These catalyst particles in stream 25 are quantitatively reduced by the invention and thusly are easier to remove from the oil which can be used as carbon black feedstock, e.g., after optional $SO_2$ extraction to produce a high BMCI oil.

When operating conventionally, that is, returning the fines from the dip-leg of the final cyclone separator back to Reactor A, the bottoms yield 25 from Fractionator A has 2.0 weight percent catalyst therein, since all of the catalyst fines remain in the system.

Although the example charges catalyst fines via 17 from the higher pressure Reactor (A) to the lower pressure Reactor (B), it is pointed out that the reactors do not have to be different in pressure and the Reactor (B) can be of higher pressure than Reactor A, the catalyst being transferred by conduit 17 by means, e.g., elevation of Reactor (A) above Reactor (B), or pneumatic or mechanical transfer of the fines. The feature is to remove part of the catalyst fines from the system which is to produce the highly aromatic feedstock for carbon black, minimizing at least ceramic grit (due to the catalyst being in the feedstock to carbon black manufacture) which will be in the carbon black product.

The catalyst from the last stage dip-leg tends to be trapped in the reactor until it is ground down to a size that will go to the fractionator in the cracked hydrocarbon vapors or will coke up to a size which will go through the catalyst stripper to the regenerator. There is, therefore, some value in removing this catalyst from the second stage dip-leg of the reactor charging only fresh feed and passing this catalyst to a reactor charging recycle stocks. This is because these coked and relatively inactive (catalytically) fines are more detrimental to the products of fresh feed cracking (due to contact in the reactor dilute phase with hydrocarbon products) than to the lower value products resulting from cracking recycle stocks. There would be even more value in removing this catalyst to a settling vessel from which entrained gas and vapor would be removed and charged to its fractionation and the catalyst either routed, as by air, to the regenerator or elutriated to remove the fines with the residue being passed to the regenerator.

Typical conventional cracking catalysts used in catalytic cracking include silica-alumina, molecular sieve type, and the like, as are known in the catalytic cracking art. Typical feedstocks can include virgin gas oils, raffinates from solvent extraction of catalytically cracked oils, recycled cycle oils, residuum oils, such as topped crude oil, as are known in this art.

Reasonable variations and modifications which will become apparent to those skilled in the art can be made in this invention without departing from the spirit and scope thereof.

I claim:

1. In a cracking process comprising (a) contacting a hydrocarbon feedstream and a cracking catalyst under cracking conditions in a cracking zone to produce a mixture of cracked hydrocarbon and cracking catalyst, (b) separating said mixture in a separation zone into a cracking catalyst mass containing coke and a fluid mass consisting essentially of said cracked hydrocarbon and cracking catalyst fines, (c) regenerating said cracking catalyst mass by contacting it with a free oxygen containing gas such as to combust at least a significant portion of said coke and to thereby produce a regenerated cracking catalyst mass, (d) reintroducing said regenerated cracking catalyst mass into said cracking zone as at least part of said cracking catalyst moves in a loop from the cracking zone to the regeneration zone and back to the cracking zone, (e) separating at least a significant portion of said cracking catalyst fines from said fluid mass, the improvement comprising (f) directly withdrawing and removing said so-separated cracking catalyst fines from said loop.

2. A process in accordance with claim 1 comprising adding fresh cracking catalyst to said loop in a quantity at least equal to the quantity of cracking catalyst fines withdrawn from said loop.

3. A process in accordance with claim 1 wherein said cracking catalyst fines withdrawn from said loop have a particle size smaller than 25 microns.

4. A process in accordance with claim 1 wherein said cracking catalyst fines are separated from said fluid by means of a cyclone system and wherein at least a portion of the solid material leaving the cyclone system is directly removed from the cyclones and out of the loop without being put back into the separation zone.

5. A twin-loop catalytic cracking process comprising (a) a first catalytic cracker-regenerator loop operation including (aa) contacting a first hydrocarbon feedstock and a cracking catalyst under cracking conditions in a first cracking zone to produce a first mixture of cracking catalyst and cracked hydrocarbons, (bb) separating said first mixture in a first separation zone into a cracking catalyst mass containing coke and a fluid mass consisting essentially of said cracked hydrocarbon and cracking catalyst fines, (cc) regenerating said cracking catalyst mass by contacting it with a free oxygen containing gas such as to combust at least a significant portion of said coke and to thereby produce a regenerated cracking catalyst mass in a first regeneration zone, (dd) reintroducing said regenerated cracking catalyst mass into said first cracking zone as at least part of said cracking catalyst so that said cracking catalyst moves in a first loop from the first cracking zone to the first regeneration zone and back to the first cracking zone, (b) separating at least a significant portion of said cracking catalyst fines from said fluid in a first catalyst fines separator, (c) a second catalytic cracker-regenerator loop operation including contacting a hydrocarbon feedstock and a cracking catalyst under cracking conditions in a second cracking zone to produce a second mixture of cracking catalyst and cracked hydrocarbons, and regenerating said cracking catalyst in a second regeneration zone, (d) directly withdrawing at least a significant portion of said cracking catalyst fines obtained from said first cracking catalyst fines separator from said first loop and (e) introducing the so separated cracking catalyst fines into said second separation zone.

6. A process in accordance with claim 5 comprising adding fresh cracking catalyst to the first loop in a quantity at least equal to the quantity of cracking catalyst fines withdrawn from said first loop and adding fresh cracking catalyst to said second loop in a quantity at least equal to the difference between the total quantity of cracking catalyst fines withdrawn from said second loop and the quantity of catalyst fines introduced from said first loop into said second loop.

7. A process in accordance with claim 5 wherein said cracking catalyst fines withdrawn from said first loop have a particle size smaller than approximately 25 microns.

8. A process in accordance with claim 5 wherein (a) a first hydrocarbon feedstock is introduced into said first cracking zone which first hydrocarbon feedstock is of higher value than a second hydrocarbon feedstock introduced into the second cracking zone off said second loop, (b) said cracked hydrocarbon from said first separation zone is introduced into a first fractionator, (c) an oil is withdrawn from said first fractionator as one product of the process, said oil having a reduced cracking catalyst content, (d) said cracked hydrocarbon from said second separation zone is introduced into a second fractionator, and (e) An oil product having an increased catalyst content is withdrawn from the second fractionator as a bottom product.

9. A process in accordance with claim 5 wherein said first regeneration zone and said second regeneration zone are contained in the same regenerator.

10. In a process for the production of a hydrocarbon oil useful as a carbon black feedstock, said process comprising (a) contacting a hydrocarbon feedstream and a cracking catalyst under cracking conditions in a cracking zone to produce a mixture of cracked hydrocarbon and cracking catalyst, (b) separating said mixture in a separation zone into a cracking catalyst mass containing coke and a fluid mass consisting essentially of said cracked hydrocarbon and cracking catalyst fines, (c) regenerating said cracking catalyst mass by contacting it with a free oxygen containing gas such as to combust at least a significant portion of said coke and to thereby produce a regenerated cracking catalyst mass, (d) reintroducing said regenerated cracking catalyst mass into said cracking zone as at least part of said cracking catalyst so that said cracking catalyst moves in a loop from the cracking zone to the regeneration zone and back to the cracking zone, (e) separating at least a significant portion of said cracking catalyst fines from said fluid mass, the improvement comprising (f) directly withdrawing and removing said so-separating cracking catalyst fines from said loop, (g) introducing said cracked hydrocarbons having reduced cracking catalyst fines content into a fractionator, (h) withdrawing an oil from the bottom of the fractionator having reduced cracking catalyst fines content, and (i) recovering a carbon black feedstock from the so removed oil.

11. A process in accordance with claim 10 wherein said oil of reduced cracking catalyst fines content removed from the bottoms of the fractionator is subjected to a solids removal step for removing a significant portion of the remaining cracking catalyst fines from the oil and to a solvent extraction step for producing a highly aromatic oil useful as a high BMCI carbon black feedstock.

* * * * *